US008863730B2

(12) United States Patent
Achstaetter et al.

(10) Patent No.: US 8,863,730 B2
(45) Date of Patent: Oct. 21, 2014

(54) HF IGNITION DEVICE

(75) Inventors: Tom Achstaetter, Hemmingen (DE); Gerd Braeuchle, Hueffenhardt (DE); Hans Delesky, Sachsenheim (DE); Thomas Giffels, Stuttgart (DE); Felizitas Heilmann, Gerlingen (DE)

(73) Assignee: BorgWarner BERU Systems, GmbH, Ludwigsburg (DE)

( * ) Notice: Subject to any disclaimer, the term of this patent is extended or adjusted under 35 U.S.C. 154(b) by 546 days.

(21) Appl. No.: 12/966,182

(22) Filed: Dec. 13, 2010

(65) Prior Publication Data

US 2011/0146640 A1 Jun. 23, 2011

(30) Foreign Application Priority Data

Dec. 19, 2009 (DE) ..... 10 2009 059 649

(51) Int. Cl.

| | |
|---|---|
| ***F02P 3/01*** | (2006.01) |
| ***H01T 13/50*** | (2006.01) |
| ***H01T 13/36*** | (2006.01) |
| ***H01T 23/00*** | (2006.01) |

(52) U.S. Cl.

CPC ..... *H01T 13/50* (2013.01); *H01T 13/36* (2013.01); *H01T 23/00* (2013.01)

USPC ..... 123/608; 123/143 R

(58) Field of Classification Search

USPC .... 123/169 R, 169 EL, 143 A, 143 B, 143 R, 123/594, 596, 604, 608; 313/141–143

See application file for complete search history.

(56) References Cited

U.S. PATENT DOCUMENTS

| | | | | |
|---|---|---|---|---|
| 4,205,215 | A * | 5/1980 | Willems | 219/121.36 |
| 4,539,503 | A * | 9/1985 | Esper et al. | 313/11.5 |
| 4,557,229 | A * | 12/1985 | Kashima et al. | 123/169 EL |
| 4,774,914 | A | 10/1988 | Ward | |
| 4,841,925 | A * | 6/1989 | Ward | 123/143 B |
| 5,750,958 | A * | 5/1998 | Okuda et al. | 219/267 |
| 8,040,029 | B2 * | 10/2011 | Agneray et al. | 313/118 |
| 8,656,897 | B2 | 2/2014 | Haution et al. | |
| 2002/0017271 | A1 * | 2/2002 | Suckewer et al. | 123/297 |
| 2005/0127809 | A1 * | 6/2005 | Lindsay | 313/141 |
| 2006/0033411 | A1 * | 2/2006 | Lindsay | 313/141 |
| 2006/0225692 | A1 * | 10/2006 | Lindner et al. | 123/253 |
| 2008/0141967 | A1 * | 6/2008 | Tani et al. | 123/143 B |
| 2008/0149083 | A1 * | 6/2008 | Katoh et al. | 123/634 |
| 2009/0107440 | A1 * | 4/2009 | Lykowski et al. | 123/169 EL |

(Continued)

FOREIGN PATENT DOCUMENTS

| | | | |
|---|---|---|---|
| CN | 101057379 | A | 10/2007 |
| CN | 2008-J74326 | * | 7/2008 |

(Continued)

*Primary Examiner* — John Kwon
*Assistant Examiner* — Johnny H Hoang
(74) *Attorney, Agent, or Firm* — Hackler Daghighian & Martino

(57) ABSTRACT

The invention relates to an HF ignition device for igniting a combustible gas mixture in an internal combustion engine, comprising a center electrode (2), an insulating body (3) through which center electrode (2) extends, a housing (4) that carries, on one end thereof, a metallic housing body (5) that encloses at least one section of insulating body (3), and comprising an external thread (5*a*) to be screwed into an internal combustion engine, and a circuit for the HF excitation of the center electrode (2). According to the invention, the section of the insulating body (3) that encloses the housing body (5) comprises an electrically conductive coating (6).

15 Claims, 3 Drawing Sheets

(56) References Cited

U.S. PATENT DOCUMENTS

| | | | | |
|---|---|---|---|---|
| 2009/0146542 | A1* | 6/2009 | Jaffrezic et al. | 313/141 |
| 2009/0189504 | A1* | 7/2009 | Malek et al. | 313/143 |
| 2009/0244802 | A1* | 10/2009 | Takeuchi et al. | 361/247 |
| 2009/0256461 | A1* | 10/2009 | Walker, Jr. | 313/137 |
| 2010/0052497 | A1* | 3/2010 | Walker et al. | 313/141 |
| 2010/0052498 | A1* | 3/2010 | Walker, Jr. | 313/141 |
| 2010/0102728 | A1* | 4/2010 | Kato et al. | 315/111.21 |
| 2010/0175654 | A1* | 7/2010 | Lykowski et al. | 123/169 EL |
| 2010/0180873 | A1* | 7/2010 | Kobayashi | 123/647 |
| 2010/0196208 | A1* | 8/2010 | Makita et al. | 422/83 |

FOREIGN PATENT DOCUMENTS

| | | | |
|---|---|---|---|
| DE | 102004058925 | A1 | 6/2006 |
| DE | 10 2006 037 246 | A1 | 2/2007 |
| DE | 102008 000 530 | A1 | 9/2008 |
| EP | 1 515 594 | A2 | 3/2005 |
| JP | S5693280 | A | 7/1981 |
| JP | H04349385 | A | 12/1992 |
| JP | H11242981 | A | 9/1999 |
| JP | 2003157952 | A | 5/2003 |
| JP | 2007280668 | A | 10/2007 |
| JP | 2008171570 | A | 7/2008 |
| WO | 2009/024713 | A1 | 2/2009 |
| WO | 2009/126864 | A2 | 10/2009 |

* cited by examiner

HF IGNITION DEVICE

The invention is directed to a high-frequency ignition device. An HF ignition device of this type is known from EP 1 515 594 A2.

To ignite a combustible gas mixture in an engine, the center electrode of such an HF ignition device is excited using a suitable circuit e.g. an HF oscillating circuit. The center electrode then radiates high-frequency electromagnetic waves into the combustion chamber of the engine, thereby creating a plasma that induces ignition.

HF ignition devices causing ignition by means of a corona discharge are an alternative to conventional spark plugs which induce ignition using an arc discharge and are subject to considerable wear due to electrode burn-off. HF ignition devices have the potential to achieve a long service life, although this has not happened yet.

The problem addressed by the present invention is therefore that of demonstrating a way to improve the service life of an HF ignition device.

SUMMARY OF THE INVENTION

To excite the center electrode to radiate high-frequency electromagnetic waves, an HF ignition device contains a circuit, typically an oscillating circuit or e.g. a piezoelectric HF generator. One element of this circuit is a capacitor, the dielectric of which is formed by the insulating body.

For frequencies of typically at least one MHz and voltages of a few kV, the dielectric strength during operation has proven to be problematic. Voltage overloads and partial discharges often cause an HF ignition device to fail prematurely.

Surprisingly, the dielectric strength can be improved markedly by providing an electrically conductive coating on the section of the insulating body that is enclosed by the metallic housing body. In the case of an ignition device according to the invention, the electrically conductive coating of the insulating body, in combination with the center electrode, forms the capacitor, the dielectric of which is the insulating body. In contrast, in the case of the ignition device made known in EP 1 515 594 A2, the metallic housing body, in combination with the center electrode, forms the capacitor, thereby resulting in a less uniform electric field and, therefore, reduced dielectric strength.

The electrically conductive coating can be e.g. a metallic coating. The electrically conductive coating is preferably a ceramic coating, however. Ceramic coatings have the advantage of great hardness. A hard coating greatly reduces the risk of damage occurring when the insulating body is inserted into the housing body. This is an important advantage since damage to the coating creates a weak spot where field peaks can occur, which result in partial discharges.

Suitable coatings include e.g. coatings of non-oxidic ceramics such as borides, in particular diborides, e.g. titanium boride or zirconium boride, carbides, in particular titanium carbide or silicon carbide, and nitrides. Nitridic ceramic coatings are particularly preferred since nitrides combine good electrical conductance with great hardness and high chemical resistance. Good results can be achieved in particular using ceramic materials based on titanium nitride and/or chromium nitride. Other possibilities include ceramic coatings based on oxides e.g. indium tin oxides, in particular indium tin oxides composed primarily of indium oxide, such as $(In_2O_3)_{1-x}(SnO_2)_x$ with $x \leq 0.2$, in particular $x \leq 0.1$.

The electrically conductive coating preferably has a thickness of less than 100 μm, particularly preferably less than 50 μm, in particular not more than 20 μm. Even very thin coatings are sufficient for improving the service life. Preferably, however, the coating has a thickness of at least 1 μm.

The insulating body of an ignition device according to the invention can be provided with an electrically conductive coating e.g. by vapor deposition, in particular PVD or CVD.

The electrical coating is preferably composed of a single layer. Multilayered coatings can also be used, however, e.g. comprising a coating based on chromium nitride and a further layer based on titanium chromium nitride.

The electrically conductive coating preferably has a sheet resistance of less than 50Ω, particularly preferably of less than 20Ω, in particular not more than 10Ω. In general, the greater the conductivity of the coating is, the easier it is to prevent field peaks which can promote voltage overloads and partial discharges.

The electrically conductive layer of the insulating body has electrical contact with the metallic housing body. During operation, the electrically conductive layer is therefore typically connected to ground, as is the metallic housing body. The insulating body can be e.g. bonded or soldered into the housing body. Preferably, however, the insulating body is retained in the housing body in a clamped manner. This can be achieved e.g. by pressing the insulator into the housing body or by thermal shrink fitting. Advantageously, the hardness of ceramic coatings is sufficient for joining processes of that type.

Preferably, the electrically conductive coating has a hardness of at least 1500 HV 0.05, particularly preferably of at least 2000 HV 0.05. These values are based on a Vickers hardness test using a test force of 0.05 kilopond.

According to an advantageous development of the invention, a coil is disposed in the housing, which, in combination with the capacitor formed by the conductive coating and the center electrode, forms the circuit for HF excitation. A circuit of that type is an oscillating circuit. The circuit is preferably a series resonant circuit. Basically, however, a parallel resonant circuit may also be used.

According to a further advantageous development of the invention, an uncoated section of the insulating body extends out of the housing body.

According to a further advantageous development of the invention, the end of the insulating body near the combustion chamber extends out of the housing body and covers the housing body at that point. In this manner, the insulating body can form a stop against which the housing body rests. Advantageously, this makes it easier to join the insulating body and the housing body e.g. by press fitting. In addition, a stop of this type can absorb the combustion chamber pressure that acts on the insulating body, thereby ensuring that seat of the insulating body in the housing body is not affected, in particular by pressure peaks that occur during engine operation.

BRIEF DESCRIPTION OF THE DRAWINGS

Further details and advantages of the invention are explained using embodiments, with reference to the attached drawings. Parts that are identical or similar are labelled using the same reference numerals. The drawings show.

DETAILED DESCRIPTION

Figure 1:
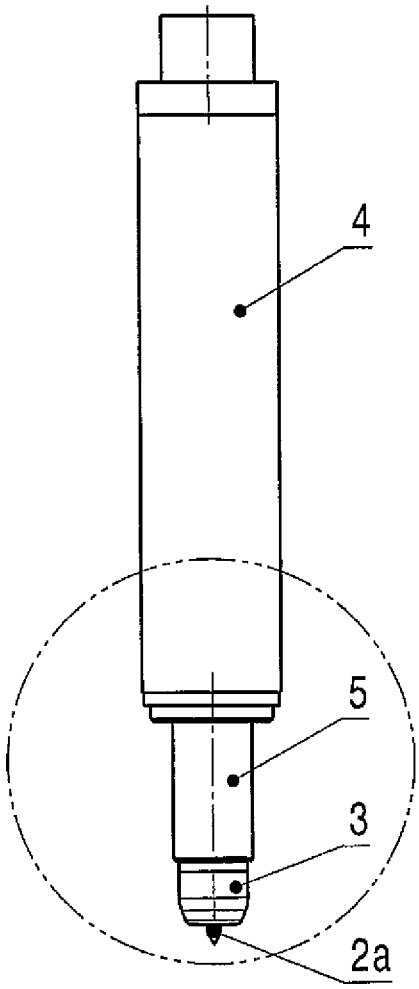
FIG. 1 a schematic depiction of an embodiment of an HF ignition device according to the invention.
Figure 2:
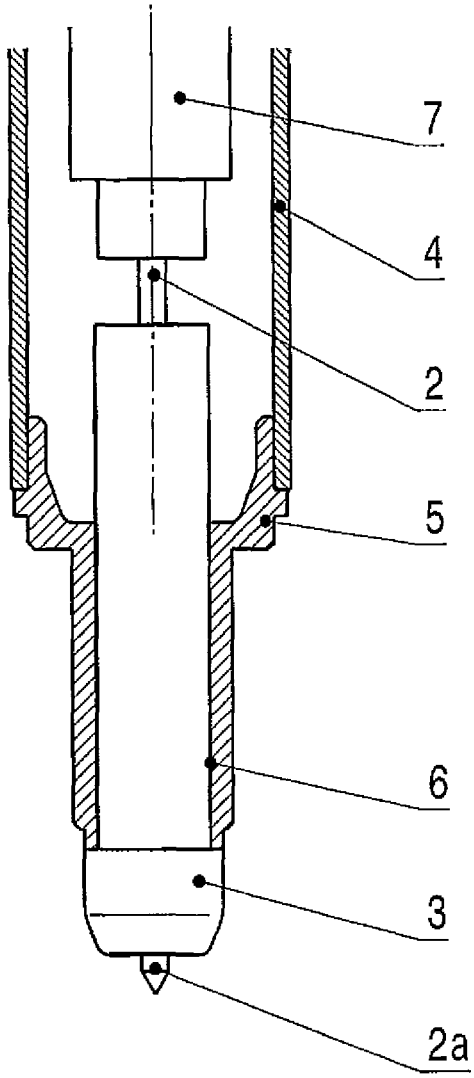
FIG. 2 a sectional view of image detail A in FIG. 1.

FIG. 1 shows a high-frequency ignition device for igniting a combustible gas mixture in an internal combustion engine. Image detail A encircled in FIG. 1 is shown in FIG. 2 in a sectional view.

The HF ignition device comprises a center electrode 2 which terminates in an ignition tip 2*a*, a ceramic insulating body 3 through which center electrode 2 extends, and a housing 4 that carries, on one end thereof, a metallic housing body 5 that encloses at least one section of insulating body 3 and comprises an external thread 5*a* to be screwed into an internal combustion engine.

The section of insulating body 3 enclosed by housing body 5 comprises an electrically conductive coating 6 that is adjacent to housing body 5 and contacts it electrically. Electrically conductive coating 6 and center electrode 2 form a capacitor, the dielectric of which is the section of insulating body 3 covered by coating 6.

This capacitor is part of a circuit for the high-frequency excitation of center electrode 2. In the embodiment shown, this circuit also comprises a coil 7 which is connected to center electrode 2. Coil 7, in combination with the capacitor, forms an electrical oscillating circuit which can be used to excite center electrode 2, thereby enabling ignition tip 2*a* thereof, which extends out of insulating body 3, to emit high-frequency electromagnetic waves that create a plasma in the combustion chamber and thereby induce ignition.

The resonant circuit has a resonant frequency of more than one MHz, preferably more than 10 MHz, particularly preferably more than 100 MHz. During operation, the ignition tip of center electrode 2 therefore emits electromagnetic waves having a frequency of more than one MHz. A frequency range of 10 MHz to 10 GHz is particularly well-suited.

Electrically conductive coating 6 is a ceramic coating in the embodiment shown. Nitridic ceramic coatings, e.g. based on titanium nitride, are particularly suitable. In the embodiment shown, the coating has a thickness of between 1 μm and 10 μm and a sheet resistance of less than 1Ω. The electrically conductive coating can be vapor deposited e.g. using PVD (physical vapor deposition) or CVD (chemical vapor deposition).

Insulating body 3 is retained in housing body 5 in a clamped manner. The insulating body can be pressed into housing body 5, for example. Another possibility in particular is to heat housing body 5 and allow it to shrink onto insulating body 3 while cooling. A thermal shrink fitting of this type, as is the case with a press-fit connection, makes it possible to create an advantageously gas-tight connection between insulating body 3 and housing body 5.

An uncoated section of the end of insulating body 3 near the combustion chamber extends out of housing body 5. The uncoated section has a larger diameter and covers housing body 5. In the embodiment shown, the end of housing body 5 near the combustion chamber is completely covered. To increase the electrical resistance between center electrode 2 and housing body 5, it is sufficient for insulating body 3 to partially cover the housing body. A larger distance reduces the risk of shunts forming.

Figure 3:
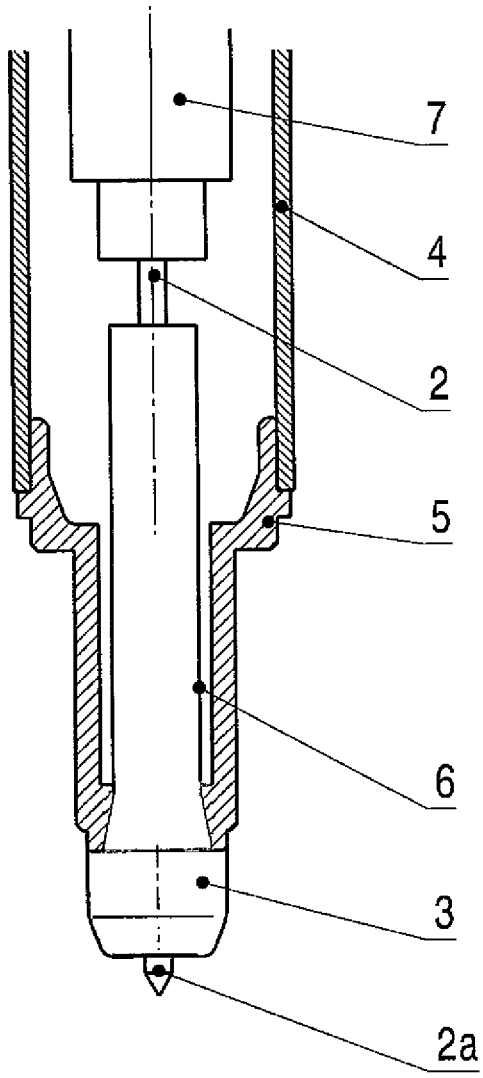
FIG. 3 a schematic depiction of a further embodiment for connecting the insulating body to the housing body.

In the embodiment depicted in FIG. 2, insulating body 3 and housing body 5 form a cylindrical pressure assembly. FIG. 3 is a schematic depiction of a modified embodiment in which ceramic insulating body 3, in combination with metallic housing body 5, forms a tapered pressure assembly. Housing body 5 can be composed e.g. of steel, and the insulating body can be composed e.g. of aluminum oxide.

REFERENCE NUMERALS

2 Center electrode
2*a* Ignition tip
3 Insulating body
4 Housing
5 Housing body
5*a* External thread
6 Coating
7 Coil

What is claimed is:

1. An HF ignition device for igniting a combustible gas mixture in an internal combustion engine, the device comprising:
- a center electrode;
- an insulating body through which the center electrode extends;
- a housing that carries, on one end thereof, a metallic housing body that encloses at least one section of the insulating body; and
- a circuit for HF excitation of the center electrode,
- wherein the at least one section of the insulating body that is enclosed by the metallic housing body comprises an electrically conductive ceramic coating.

2. The ignition device according to claim 1, wherein the electrically conductive ceramic coating is composed of a nitridic ceramic.

3. The ignition device according to claim 1, wherein the electrically conductive ceramic coating has a thickness of less than 100 μm.

4. The ignition device according to claim 1, wherein the electrically conductive ceramic coating has a thickness of at least 1 μm.

5. The ignition device according to claim 1, wherein the electrically conductive ceramic coating has a sheet resistance of less than 50Ω.

6. The ignition device according to claim 1, wherein the insulating body is retained in the metallic housing body in a clamped manner.

7. The ignition device according to claim 1, wherein an end of the insulating body near the combustion chamber extends out of the metallic housing body.

8. The ignition device according to claim 1, wherein an uncoated section of the insulating body extends out of the metallic housing body.

9. The ignition device according to claim 1, wherein the electrically conductive ceramic coating was created by vapor deposition.

10. The ignition device according to claim 1, wherein the electrically conductive ceramic coating comprises a thickness of less than 50 μm.

11. The ignition device according to claim 1, wherein the electrically conductive ceramic coating comprises a thickness of less than 20 μm.

12. The ignition device according to claim 1, wherein the electrically conductive ceramic coating comprises a sheet resistance of less than 20Ω.

13. The ignition device according to claim 1, wherein the electrically conductive ceramic coating comprises a sheet resistance of less than 10Ω.

14. An HF ignition device for igniting a combustible gas mixture in an internal combustion engine, the device comprising:
- a center electrode;
- an insulating body through which the center electrode extends;
- a housing that carries, on one end thereof, a metallic housing body that encloses at least one section of the insulating body; and
- a circuit for HF excitation of the center electrode,
- wherein the at least one section of the insulating body enclosed by the metallic housing body comprises an electrically conductive nitridic ceramic coating.

15. An HF ignition device for igniting a combustible gas mixture in an internal combustion engine, the device comprising:

an insulating body;

a center electrode extending through the insulating body;

a circuit electrically coupled to the center electrode configured for HF excitation of the center electrode;

a metallic housing body enclosing at least one section of the insulating body; and an electrically conductive nitridic ceramic coating disposed on the at least one section of the insulating body enclosed by the metallic housing body;

wherein the electrically conductive nitridic ceramic coating, the insulating body and the center electrode comprise a capacitor.

* * * * *